US005165551A

United States Patent [19]

Frost

[11] Patent Number: 5,165,551

[45] Date of Patent: Nov. 24, 1992

[54] APPARATUS AND METHOD FOR DETECTING DEFECTS IN AN ARTICLE

[75] Inventor: Robert J. Frost, Tamworth, England

[73] Assignee: Automation Associates, Inc., Arlington Heights, Ill.

[21] Appl. No.: 556,831

[22] Filed: Jul. 23, 1990

Related U.S. Application Data

[63] Continuation-in-part of Ser. No. 502,510, Mar. 30, 1990, abandoned.

[51] Int. Cl.[5] ..... B07C 5/00; B07C 5/36

[52] U.S. Cl. ..... 209/538; 198/379; 209/555; 209/567; 209/604; 209/919; 209/929; 324/226; 414/225

[58] Field of Search ..... 209/538, 555, 556, 567, 209/570, 571, 644, 598, 600, 601, 604, 929, 919, 912, 688, 619; 324/226, 234, 236-240, 260-262; 198/379; 73/865.8; 414/222, 225

[56] References Cited

U.S. PATENT DOCUMENTS

| | | | |
|---|---|---|---|
| 3,101,147 | 8/1963 | Fry et al. | 209/598 X |
| 3,414,127 | 12/1968 | Sorbie | 209/538 X |
| 3,417,476 | 12/1968 | Martens | 209/604 X |
| 3,539,006 | 11/1970 | Hanna et al. | 209/567 X |
| 3,601,616 | 8/1971 | Katsumata | 209/524 X |
| 3,739,908 | 6/1973 | Gunther | 209/929 X |
| 3,811,567 | 5/1974 | Tomita et al. | 209/644 X |
| 3,863,349 | 2/1975 | Wilson | 324/234 X |
| 4,437,985 | 3/1984 | Hinds et al. | 209/538 |
| 4,723,648 | 2/1988 | Hamatani | 198/379 |
| 4,877,138 | 10/1989 | Motiwala | 209/929 X |
| 4,905,842 | 3/1990 | Habele et al. | 209/929 X |

FOREIGN PATENT DOCUMENTS

| | | | |
|---|---|---|---|
| 1255254 | 6/1989 | Canada | 209/929 |
| 33501 | 4/1981 | Japan | 209/604 |
| 1604841 | 6/1982 | United Kingdom . | |
| 1604842 | 6/1982 | United Kingdom . | |

OTHER PUBLICATIONS

Coleman et al, "On-Line Automatic High Speed Inspection of Cartridge Cases" *ASTM Standardization News*, vol. 3, No. 3, pp. 31-34, Mar. 1975.

*Primary Examiner*—Donald T. Hajec

*Attorney, Agent, or Firm*—Wood, Phillips, VanSanten, Hoffman & Ertel

[57] ABSTRACT

An apparatus for detecting defects in discrete articles, such as fasteners having an indexable article carrier with a plurality of article holders on the article carrier for supporting articles in a holding position so that each article in the holding position moves in a prescribed path as the article carrier is operated; structure for incrementally indexing the article carrier to position each article holder alternatively in (a) a first position in which an article can be inserted therein from a supply, and (b) a second position spaced from said first position; structure for shifting an article in a holder in the second position out of the holding position therefor into an inspecting position and for rotating an article in a holder in an inspecting position so that the complete periphery of an article to be inspected is exposed for examination is included; and eddy current scanning structure for examining the exposed part of an article while being rotated in the inspection position therefor.

20 Claims, 4 Drawing Sheets

APPARATUS AND METHOD FOR DETECTING DEFECTS IN AN ARTICLE

BACKGROUND OF THE INVENTION

Cross-Reference to Related Application

This application comprises a continuation-in-part of my copending application Ser. No. 502,510, filed Mar. 30, 1990, entitled "An Apparatus and Method for Detecting Defects in an Article" now abandoned.

FIELD OF THE INVENTION

This invention relates to a method and apparatus for performing eddy current examination of relatively lightweight articles, such as headed fasteners.

BACKGROUND ART

It is common in the manufacture of lightweight metal fasteners to produce the fasteners in an automated process, whereby hundreds of articles are formed each minute. In order to maintain a high degree of quality control, it is important to include a step in the manufacturing process whereby a high volume stream of fasteners may be easily examined for conformity with established production standards.

Typically, a plurality of fasteners are advanced along a manufacturing line by means of physically engaging the extending flanges of a headed portion in a gripping mechanism and sequentially feeding the fasteners through an examination station. A common way of efficiently feeding a fixed number of fasteners, say 10 or 20, in consecutive batches through an examination station, is to load a batch of fasteners into a carriage/carrier which is then incrementally indexed through the examination station, whereby each fastener is in turn subjected to examination. The fasteners are supported within the carriage by means of engagement of the head of the fastener with an adapted receiving surface. After a fastener is examined, it is subsequently discharged from the carriage into either a 'reject' receptacle or, if conforming, into an 'accept' receptacle. A supply of fasteners is continuously directed into the vacancies established in the carriage by the discharge of examined fasteners.

In order to insure an acceptable level of material integrity within the fastener, it is becoming popular to subject metal fasteners to eddy current examination, whereby a high frequency current is induced into the surface of the fastener. Analysis of the resulting signal provides information representative of the existence of cracks in the fastener, material composition, and the presence of various surface treatments.

A significant problem with eddy current examination of fasteners is that due to the manner in which the fastener is advanced through the examination station, namely, by being suspended from a carriage with the underside of the head resting on a support surface, it is not possible to induce eddy current into the area of the fastener at the interface of the shank and the head. Unfortunately, this shank-head interface is the area of the fastener where material defects most often arise in the manufacturing process. Thus, the portion of the fastener which is most critical to establishing the acceptability of the article is inaccessible to eddy current examination. Furthermore, a fully comprehensive eddy current examination requires that the entire periphery of the fastener be subjected to the electromagnetic field of the differential eddy current probe. Advancing the fastener along a feed path in an orientation fixed relative to that of the eddy current probe allows the examination of only a fraction of the critical head-shank interface.

An additional problem exists with respect to damage to the eddy current probe. In order to optimize the scanning capability of the probe it is important to position the head of the probe as closely as possible to the fastener being examined. However, due to nonuniformity of the sizes of the heads, a fastener having an oversized head may come into contact with a probe positioned too closely to the examination station. This contact leads to costly damage to the eddy current scanning equipment as well as to the downtime associated with a crippled quality inspection line.

No solution currently exists for solving the above identified problems. Current manufactures are faced only with the option of scanning areas away from the shank-head interface and attempting to infer from that measurement the condition of the fastener directly under the head. Additionally, eddy current probes must be spaced from the examination a distance sufficient for improperly formed heads to avoid contact with the probes.

DISCLOSURE OF THE INVENTION

The present invention comprehends an improved defect detection apparatus in which a plurality of light weight articles are sequentially subjected to eddy current examination, with the articles being positioned in view of a fixed position spring-loaded surface running eddy current probe in such an attitude as to insure comprehensive examination of the article.

More particularly, the invention comprehends an apparatus for detecting defects in articles such as fasteners, said apparatus consisting of an indexable article carrier with a plurality of article holders on the article carrier for supporting articles in a holding position so that each article in the holding position moves in a prescribed path as the article carrier is operated; structure for incrementally indexing the article carrier to position each article holder alternatively in (a) a first position in which an article can be inserted therein from a supply, and (b) a second position spaced from the first position; structure for shifting an article in a holder in the second position out of the holding position therefor into an inspecting position so that a part of an article to be inspected is exposed away from the article carrier; and ascanning mechanism for examining the exposed part of an article in the inspecting position therefore.

In one form of the invention, the structure for shifting an article in a holder in the second position out of the holding position therefor into an inspecting position includes a reciprocable shaft movable into contact with a portion of an article in the holding position.

In one form of the invention, an eddy current probe is provided for examining the exposed part of an article in the inspection position.

In the illustrated embodiment, included are a plurality of conduits connected to a source of pressurized air and directed toward articles in the article holders for delivering air jets thereagainst and thereby expelling articles from the article carrier.

In one form, the article carrier may be incrementally indexed to a third position between the first and second positions wherein the presence of unacceptably formed articles supported on the article carrier may be detected, with gauging means being provided for determining the unacceptability.

In one form of the invention, the gauging means is a deployable probe having an end adapted to cooperate with an article supported on the article carrier in the third position and a photoelectric sensor for detecting the degree of deployment of the probe to thereby determine acceptability/unacceptability.

The invention further comprehends an apparatus for detecting defects in discrete articles, such as fasteners, said apparatus having an indexable article carrier having a plurality of article holders for supporting articles in a holding position so that each article in the holding position moves in a prescribed path as the article carrier is operated; structure is provided for incrementally indexing the article carrier to position each article holder alternatively in (a) a first position in which an article can be inserted therein from a supply, and (b) a second position spaced from said first position; and structure for rotating an article in a holder in the second position so that part, and preferably all, of the periphery of an article can be inspected.

In one form of the invention, structure is provided to shift an article in a holder in the second position out of the holding position as the article is rotated to expose a part of the article away from the carrier for inspection.

In one form of the invention, the structure for rotating an article includes a pair of converging elements for captively gripping an article therebetween, with one of the elements being a driving element.

In one embodiment, the driving element has an end adapted for frictional engagement with an article.

In an alternative embodiment, the driving element has an end with surfaces adapted for penetrable engagement with a recess formed in an article.

The invention still further comprehends a method for detecting defects in discrete articles, such as fasteners, including the steps of supporting a plurality of articles within article holders on an indexable article carrier in a holding position so that each article in the holding position moves in a prescribed path as the article carrier is operated; incrementally indexing the article carrier to position each article holder alternatively in (a) a first position in which an article can be inserted therein from a supply, and (b) a second position spaced from said first position; shifting an article in a holder in the second position out of the holding position therefor into an inspecting position; and examining the exposed part of an article in the inspecting position therefor.

The invention also comprehends the step of rotating an article in the inspecting position so that part, and preferably all, of the periphery of the exposed part of the article can be inspected.

In one form, the method includes the step of incrementally indexing the article carrier to a third position between the first and second position wherein the presence of unacceptably formed articles supported on the article carrier may be detected.

The invention is particularly adapted to inspect fasteners, such as those having an enlarged head and integral shank. The shank extends through a slot in the carrier and is suspended from the carrier by the head in the rotating position.

BRIEF DESCRIPTION OF THE DRAWINGS

Other features and advantages of the invention will be apparent from the following description taken in connection with the accompanying drawings wherein.

BEST MODE FOR CARRYING OUT THE INVENTION

Figure 1:
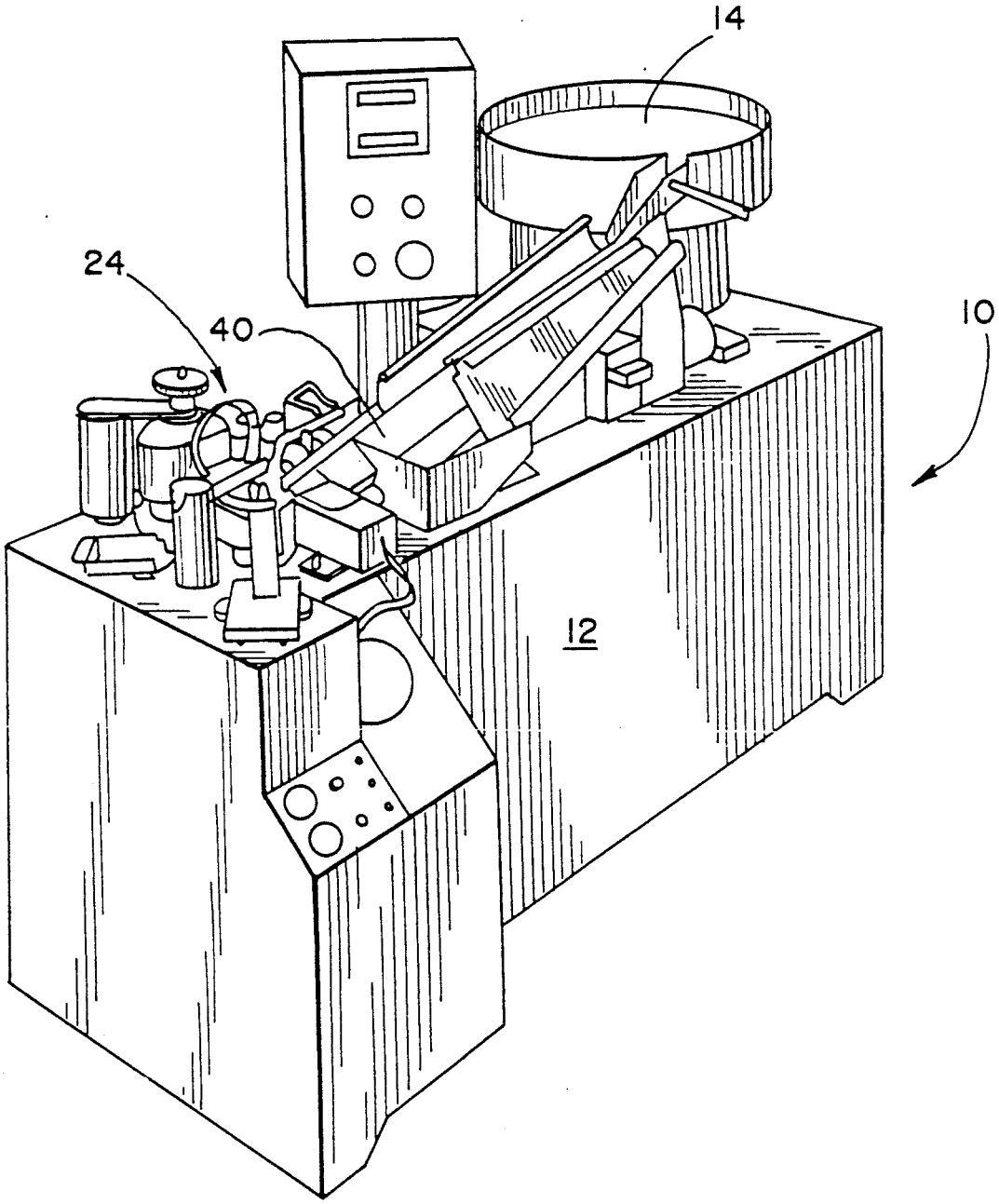
FIG. 1 is a perspective view of an apparatus for performing high volume inspection of discrete articles according to the present invention.

An inspection/sorting apparatus, suitable for incorporation of the present invention, is shown in FIG. 1 at 10, with details thereof depicted in FIGS. 2–8. The apparatus 10 has a support housing 12 on which is mounted a container 14, in the form of a hopper, for accepting a supply of discrete articles to undergo examination. The apparatus 10 is described herein as it would be used to examine screw blanks/fasteners 16, each having a shank portion 18 with a center axis 20 (FIGS. 6 and 7) and a concentric head portion 22 integral therewith. The apparatus 10 is designed to identify defects in the material integrity of the shank and head portions 18,22 on the screw blanks/fasteners 16 at a gauging/inspection station 24. It should be understood that one or more additional inspections can be carried out on the screw blanks/fasteners 16 on the apparatus 10, however, the focus will be on the inventive inspecting structure primarily for the head and shank portions 18,22.

Additional details of the overall apparatus 10, peripheral to the gauging/inspection station 24, are omitted herein and are set out fully in British Patent Specification Nos. 1,604,841 and 1,604,842. It suffices to say that the apparatus 10 has a means at 26 for delivering the blanks/fasteners 16 from the supply in the container 14 in succession to the gauging/inspection station 24 in a head-up orientation. It should also be understood that discrete articles other than the screw blanks/fasteners 16 shown can be inspected using the inventive structure-the screw blanks are only exemplary.

Carrier/advancing means at 28 is provided for receiving the blanks/fasteners 16 from the delivery means 26, advancing the blanks/fasteners 16 serially through a gauging station 30, a first reject station 32, an examination station 34, a second reject station 36, and finally to a pass station 38.

The delivery means 26 has an elongate guideway 40 defined between adjacent, parallel rails 42,44 spaced by less than the diameter of the head portions 22 of the blanks/fasteners 16. The rails 42,44 are driven in a vibratory mode and inclined downwardly from the supply container 14. The blanks/fasteners 16 move downwardly in the guideway 40 under the combined effects of gravity and the vibratory movement to the carrier means 28.

Figure 2:
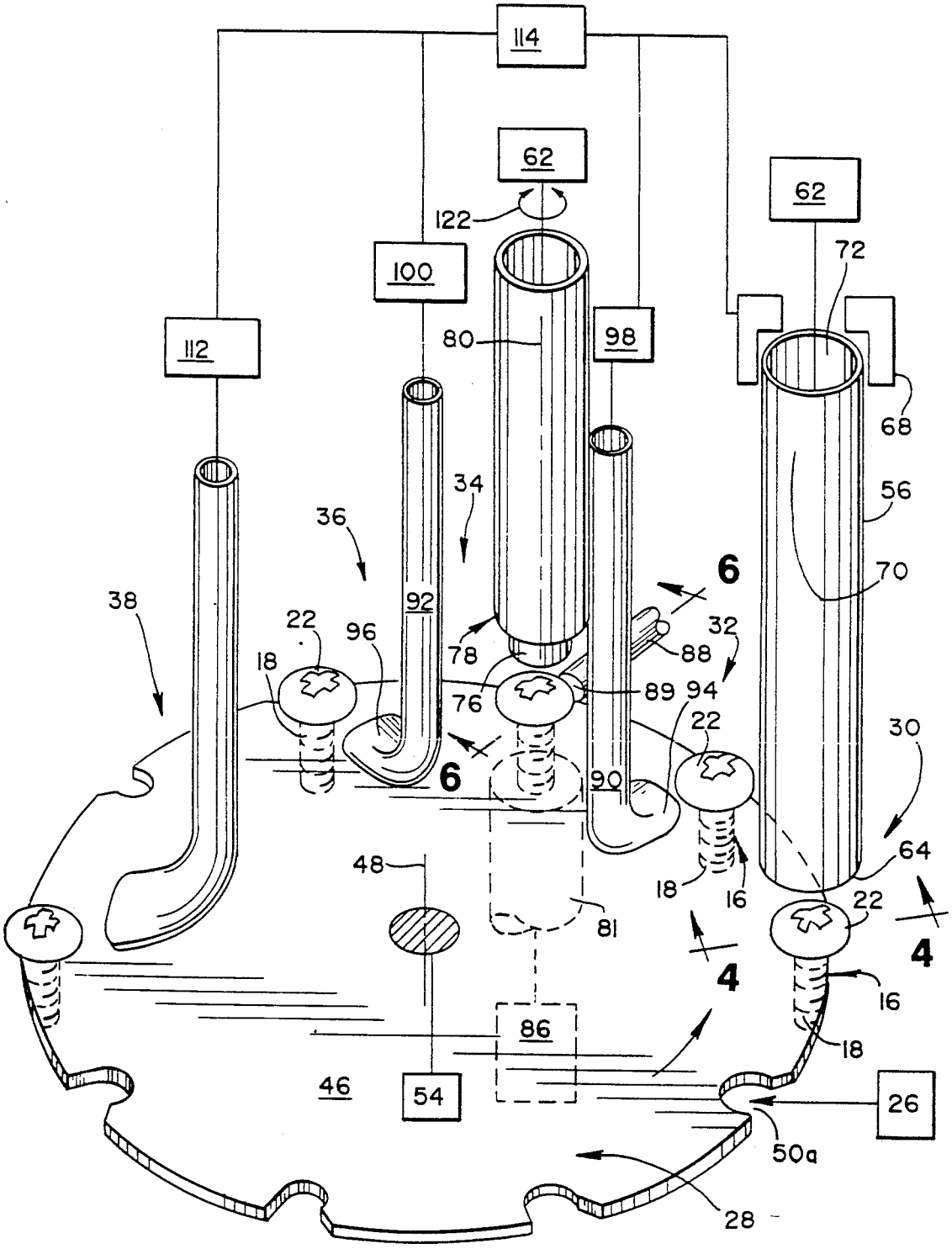
FIG. 2 is a fragmentary perspective view of an inspection/gauging station according to the invention on the apparatus of FIG. 1.
Figure 3:
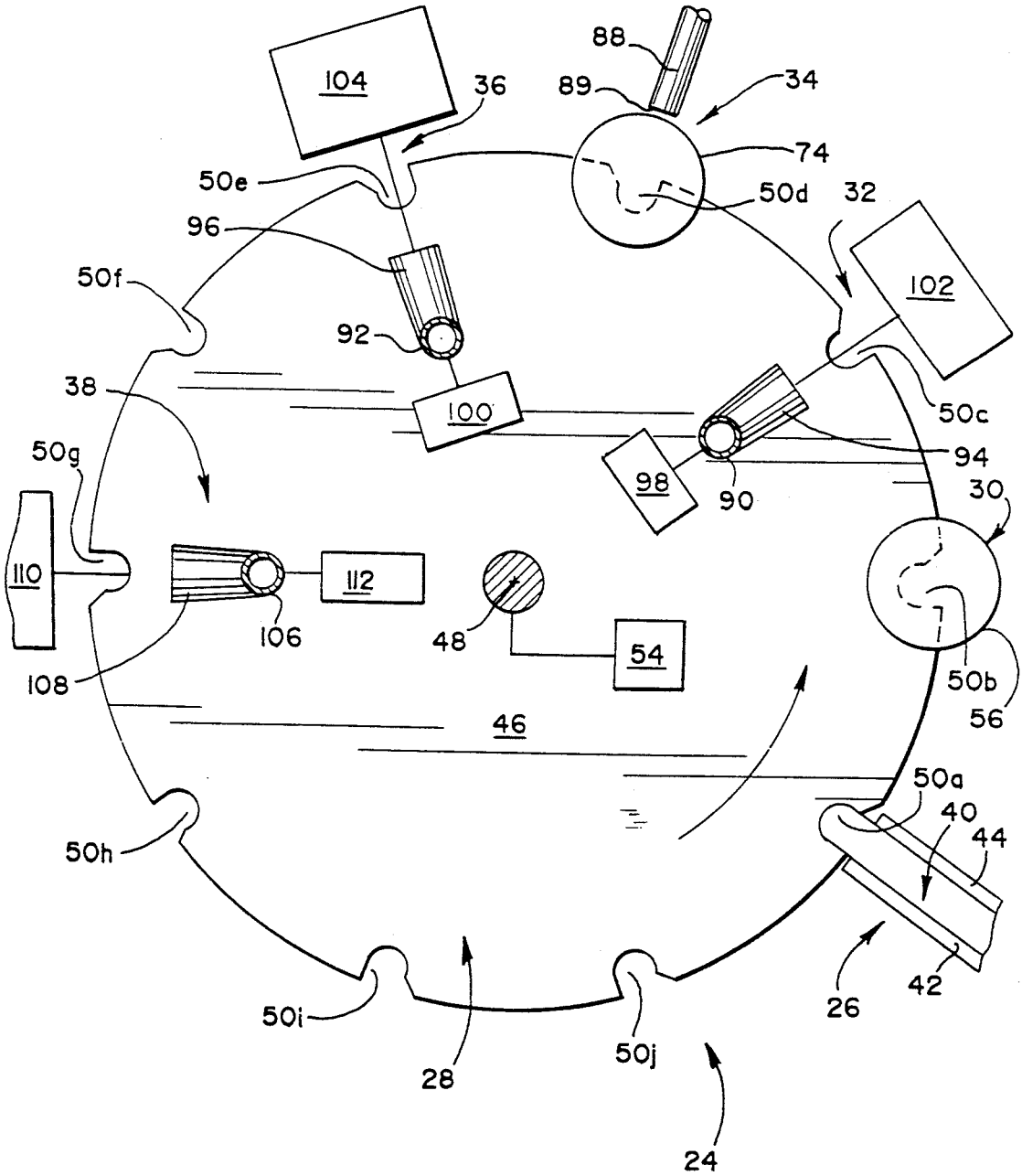
FIG. 3 is a plan view of the inspection/gauging station in FIG. 2.
Figure 4:
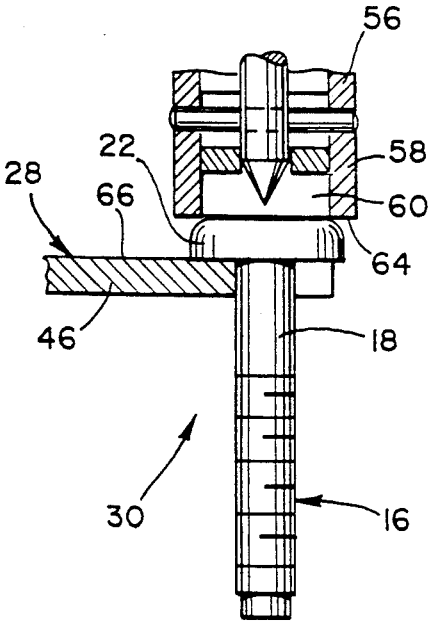
FIG. 4 is a sectional view of a gauging station taken along line 4—4 of FIG. 2.
Figure 5:
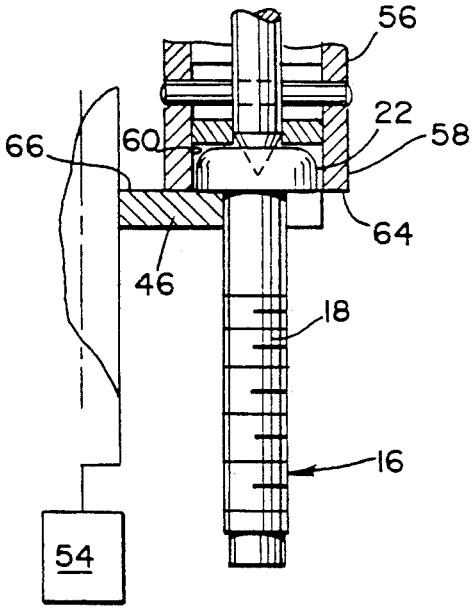
FIG. 5 is a sectional view of the gauging station as in FIG. 4.
Figure 6:
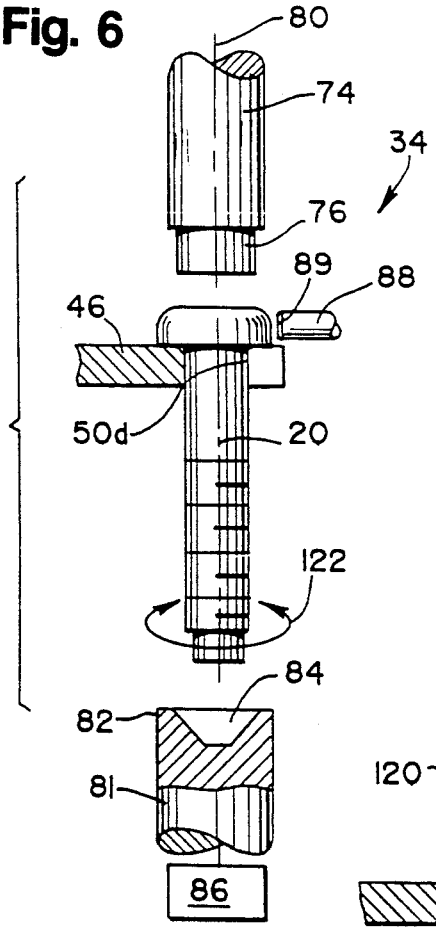
FIG. 6 is a sectional view of an inspection station taken along line 6—6 of FIG. 2, with structure for repositioning/rotating a fastener in an inoperative position.

The carrier means 28 further includes an article carrying disc 46 mounted for rotation about a vertical axis 48 and having equidistantly spaced, radially extending article holders/slots 50(*a*)–50(*j*) about its periphery, for example, ten in number, which receive blanks/fasteners 16 from the delivery means 26 and support the same head up in a holding position, as shown in FIGS. 4–6. The disc 46 rotates to advance the blanks/fasteners 16 through the stations 30,32,34,36, and 38 described above. As best seen in FIGS. 2 and 3, the disc 46 is carried by a vertical shaft 52 connected at its lower end to a driving motor 54 mounted in the housing 12.

Referring now to FIGS. 2–5, the first gauging station 30 has a vertically oriented elongate shaft 56 positioned above the disc 46 in coaxial alignment with a slot 50*b* in the disc 46 indexed therebelow. The shaft 56 has an end fitting 58 with an inverted cup-shape defining a receptacle 60. The shaft is vertically reciprocable by a mechanism, shown schematically at 62 in FIG. 2. At the bottom of the shaft stroke, an annular rim 64, on the bottom of the fitting 58, comes into contact with the flat upper surface 66 of the disc. Shaft position sensing means 68 of a photoelectric type known to the skilled artisan, adjacent the shaft upper end 70 of the shaft 56, is operational to generate an electrical signal representative of the position of the shaft end 72.

Figure 7:
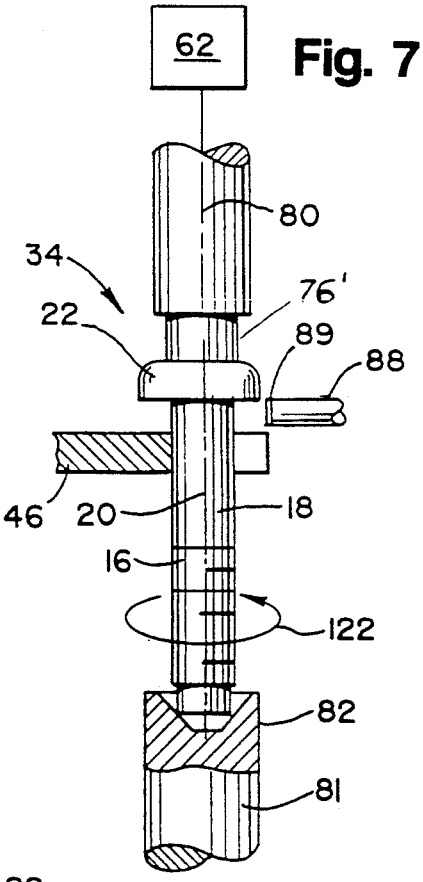
FIG. 7 is a view as in FIG. 6 with the structure for repositioning/rotating a fastener in an operative position.
Figure 8:
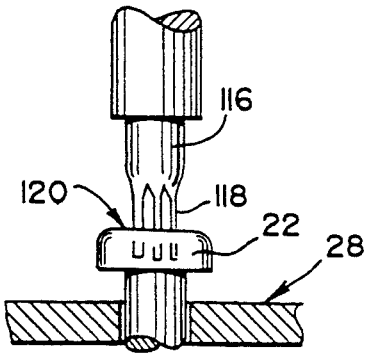
FIG. 8 is a view as in FIG. 7 with a modified form of repositioning/rotating structure.

The examination station 34, seen clearly in FIGS. 2, 3 and 6–8, has a vertically reciprocable shaft 74 mounted above the disc 46 in coaxial alignment with a slot 50*d* in the disc 46 that is indexed therebelow. The shaft 74 has a pressure pad 76 at a lower end 78 hereof. An alternative, larger diameter pad 76' is seen in FIG. 7. The shaft 74 is operated by the mechanism 62 so that the pressure pad 74 is moved selectively towards and away from the disc 46. The mechanism 62 also rotates the shaft 74 about its lengthwise axis 80.

The examination station 34 also has a vertically movable bearing 81 positioned below the disc 46 and in alignment with the slot 50*d*. The bearing 81 has an upper end 82 with an undercut 84 adapted to engage the depending free end of the shank of a blank/fastener 16 within the slot 50*d*. Preferably, the bearing 81 is controlled by a pneumatic driving cylinder 86 of a type commonly known to those skilled in the art.

An eddy current sensing probe 88 is fixedly secured to the housing 12 such that the probe head 89 is in close proximity to the examination station 34 whereby an eddy current signal may be induced into a blank/fastener 16 positoned within the slot 50*d*.

The reject stations 32,36 (FIGS. 2 and 3) have conduits 90,92 with radially directed outlet arms 94,96, each connected to a source of pressurized air 98,100, respectively, for directing a high pressure jet of air along the surface of the disc 46 and toward the heads 22 of the blanks/fasteners 16 within slots 50*c* and 50*e*, respectively. In this way, controlled jets of air forcibly discharge predetermined rejected fasteners away from the apparatus 10 and into reject receptacles 102,104. In a similar way, the pass station 38 has a conduit 106 with an arm 108 to produce a radially directed stream of air toward a blank/fastener 16 carried by the slot 50*g* to thereby discharge an acceptable fastener into an appropriate receptacle 110. The conduit 106 is supplied from a suitable pressurized supply 112.

Operation of the apparatus is best illustrated in FIGS. 2 through 8. A stream of blanks/fasteners 16 is advanced along the guideway 40 under the influence of gravity and vibratory movement toward the disc 46. The disc 46 is indexed such that the blanks/fasteners 16 are consecutively moved into the slots 50(*a*)–50(*j*) aligned at the end of the guideway 40. While it should be noted that hundreds of blanks/fasteners 16 may be loaded into and discharged from the disc 46 in each minute of operation on the inspecting/sorting apparatus, the following description will trace the path of only a single blank/fastener 16 through a cycle. The process below may be directly extrapolated to every fastener examined.

After a blank/fastener 16 is received by the disc 46 aligned at the end of the guideway 40, indexing of the disc 46 moves the blank/fastener 16 the first gauging station 30. The overhead vertical shaft 56 is driven downwardly such that the head 22 of the blank/fastener 16 immediately therebelow rests in the receptacle 60. If the head 22 is acceptably formed, both in terms of size and concentric relationship with the shank 18, the head 22 will completely seat within the receptacle 60 and and the shaft 56 will be allowed to reach its maximum downward stroke position, as shown in FIG. 5. If the head 22 is improperly formed, however, as in FIG. 4, the head 22 will interfere with the rim 64 of the fitting 58, thereby preventing the shaft 56 from reaching its maximum downward stroke position.

The shaft position sensor 68 at the upper end 70 of the shaft 56 is operational to relay an electrical signal back to a controller 114 that is representative of the amount of travel of the shaft 56. When the head 22 of a blank/fastener 16 is properly formed and the shaft 56 is fully deployed, the upper end 72 of the shaft 56 passes through the sensor and no signal is generated. When the head 22 is improperly formed and the shaft travel is obstructed, the upper end 70 does not pass through the sensor 68 and an electrical reject signal 50 is generated and received by and stored in the controller 114. Once the blank/fastener head 22 has been "inspected", the shaft 32 is upwardly retracted as the disc 46 is indexed so that the blank/fastener 16 is moved to the first reject station 32. In the event that a reject signal was generated by the shaft position sensor 68 at the gauging station 30, commonly known logic means relay to the reject station 32 and causes a charge of air to be released from the air source 98 so as to radially direct a pulse of high pressure air toward the head 22 of the blank/fastener 16 such that the blank/fastener 16 is forcibly expelled from the disc 46 and into the reject-storing receptacle 102. If the head 22 of the blank/fastener 16 has an acceptable configuration and a reject signal was not generated at the gauging station 30, no air is released from the air source 98 and the blank/fastener 16 proceeds to the next index position.

A subsequent incremental rotation of the disc 46 delivers the blank/fastener 16 to the examination station 34. At this point, the air-powered bearing 81 is moved vertically into contact with the blank/fastener 16 carried in the overhead slot 50*d* so that the free end of the shank 18 seats in the undercut 84. The bearing 81 is moved upwardly to the point that the head 22 of the blank/fastener 16 is elevated above the disc 46 into an inspecting position therefor. In this way, the region of the blank/fastener 16 where the head 22 and the shank 18 join are exposed for receiving eddy currents transmitted by the probe head 89.

As the blank/fastener 16 is being upwardly translated the shaft 74 is actuated by the mechanism 62 so that the pressure pad 76 is forced into engagement with the head 22 of the blank/fastener 16. The blank/fastener 16 is captively held between the bearing 81 and the shaft 74. As shown in the alternative embodiment in FIG. 8, a formed bit 116 having surfaces 118 adapted for penetration into a mating recess 120 in a head 22 may be substituted for the pressure pad 76.

Once the blank/fastener 16 is clamped between the shaft 74 and the bearing 81 with the head 22 lifted above the disc 46, the mechanism 62 is actuated to rotate the shaft 74 as indicated by the arrow 122. Due to the frictional engagement of the pressure pad 76 with the head 22, or, alternatively, the engagement of the bit 116 with the recess 120 formed in the head 22, rotary motion is transmitted to the blank/fastener 16. The bearing 81 allows the blank/fastener 16 to rotate freely under the energization of the rotating shaft 74. With this construction, it is possible to subject the underside of the head 22 and upper end of the shank 18 to an eddy current examination through 360° of rotation. Because blanks/fasteners 16 having improperly formed heads 22 are previously rejected at the first reject station 32, it is not possible for an oversized head 22 to come into contact with the probe head 89, which might cause costly damage.

Following a comprehensive eddy current examination of the blank/fastener 16, the shaft 74 and bearing 81 are moved axially away from each other, with the blank/fastener 16 being thereby returned to its static holding position in which it is suspended from its head 22 within one of the slots 50(*a*)–50 (*j*). Once the blank/fastener 16 is again seated on the disc 46, the disc 46 is indexed, whereby the blank/fastener 16 is moved to the second reject station 36.

In the event that an unfavorable material characteristic is identified at the examining station 34 through eddy current examination, the eddy current probe 89 generates a representative electrical reject signal through the controller 114 which in turn produces an operator signal to the second reject station 36. Reception of a reject signal acts to release air from the source 100 to direct a radial pulse of high pressure air toward the head 22 of the blank/fastener 16 in slot 50*e* such that the blank/fastener 16 is forcibly expelled from the disc 46 and into its reject-storing receptacle 104. Where a defective condition is not identified at the examining station 34, no electrical signal is relayed and, thus, the blank/fastener 16 is not ejected from the disc 46 at the second reject station 36.

Further indexing of the disc 46 advances the blank/fastener 16 toward the pass station 38. A continuous stream of air is directed through the conduit 20 from the air supply 112 toward the slot 50*g* such that any blank/fastener 16 reaching the pass station 38 is immediately expelled from the disc 46 and into a storage receptacle 110. With this arrangement, a blank/fastener 16 is assured of being ejected from a seat on the disc 46 by the time the slot carrying the blank/fastener 16 has been indexed up to the pass station 38. Further indexing of the disc 46 returns the empty slot to the line of incoming blanks/fasteners 16 for continuous feeding through the apparatus 10.

We claim:

1. An apparatus for detecting defects in discrete articles, said apparatus comprising:

an indexable article carrier;

a plurality of article holders on said article carrier for engaging a portion of said articles and thereby supporting said articles in a holding position so that each article in the holding position moves in a prescribed path as the article carrier is operated;

means for incrementally indexing the article carrier to position said article carrier alternatively in (a) a first position in which an article is inserted therein from a supply, and (b) a second position spaced from said first position;

means for shifting an article in a holder in the second position out of the holding position therefor into an inspecting position so that a part of an article to be inspected is exposed away from the article carrier, said exposed part to be inspected including said portion of said article engaged by an article holder on the carrier with the article in the holding position therefor; and means for examining the exposed part of an article in the inspection position therefor.

2. The apparatus of claim 1 wherein said means for shifting an article in a holder in the second position out of the holding position therefor into the inspecting position includes a reciprocable shaft movable into contact with a portion of an article in the holding position.

3. The apparatus of claim 1 wherein said means for examining the exposed part of an article in the inspecting position thereof comprises eddy current scanning means.

4. The apparatus of claim 1 having means for expelling articles from said article carrier.

5. The apparatus of claim 4 wherein said article expelling means includes a conduit connected to a source of pressurized fluid and directed through said conduit toward an article in an article holder.

6. The apparatus of claim 1 having means for incrementally indexing the article carrier to a third position intermediate said first and said second position wherein the presence of unacceptably formed articles supported on said article carrier may be detected, and means for determining said unacceptability.

7. The apparatus of claim 6 wherein said means for determining unacceptably formed articles comprises a deployable probe having an end adapted for engagement with an article supported on said article carrier in said third position and means for detecting the degree of deployment thereof.

8. The apparatus of claim 7 wherein said deployment detecting means comprises photoelectric means.

9. The apparatus of claim 1 in conjunction with a means for automatically delivering articles to article holders in said first position.

10. An apparatus for detecting defects in discrete fastening articles having a head and an elongate shank, said apparatus comprising;

an indexable article carrier;

a plurality of article holders on said article carrier for engaging an underside of said article heads and thereby supporting said articles in a holding position so that each article in the holding position moves in a prescribed path as the article carrier is operated;

means for incrementally indexing the article carrier to position said article carrier alternatively in (a) a first position in which an article is inserted therein from a supply, and (b) a second position spaced from said first position;

means for shifting an article in a holder in the second position out of the holding position therefor into an inspecting position whereby the underside of the article head engaged by the carrier with the article in a holding position therefor is exposed for examination;

means for rotating an article in a holder in an inspecting position so that the entire periphery of an article head and shank to be inspected is exposed for examination; and means for examining the underside of an article being rotated by a holder in the inspection position.

11. The apparatus of claim 10 wherein said means for rotating an article in a holder includes a pair of elements for captively gripping an article therebetween, with one of said elements being a driving element.

12. The apparatus of claim 10 wherein said means for rotating includes means for shifting an article in a holder in the second position therefor out of the holding position into an inspecting position.

13. The apparatus of claim 11 wherein said driving element has an end adapted for frictional engagement with an article.

14. The apparatus of claim 11 wherein said driving element has an end with surfaces adapted for penetrable engagement with a recess formed in an article.

15. A method for detecting defects in discrete articles comprising the steps of:

engaging a portion of said articles with article holders on an indexable article carrier and thereby supporting said articles in a holding position so that each article in the holding position moves in a prescribed path as the article carrier is operated;

incrementally indexing the article carrier to position said article carrier alternatively in (a) a first position in which an article can be inserted therein from a supply, and (b) a second position spaced from said first position;

shifting an article in a holder in the second position out of the holding position therefor into an inspecting position; and examining the exposed part of an article while in the inspection position therefor, said exposed part including said portion of said article engaged by the article carrier with the article in the holding position therefor.

16. The method of claim 15 including the step of incrementally indexing the article carrier to a third position and detecting the presence of unacceptably formed articles supported on said article carrier.

17. The method of claim 15 including the step of rotating an article in the inspecting position so that at least part of the periphery of the exposed part of an article can be inspected.

18. The method of claim 17 including the step of rotating an article in the inspecting position through a full 360° so that the entire periphery of an exposed part of an article can be inspected.

19. The method of claim 15 wherein the discrete articles are headed fasteners with a shank and including the step of supporting the articles on the carrier by resting the heads of the articles on the carrier.

20. The method of claim 19 including the step of sensing the head size of articles to be certain that the head size is within an acceptable range before the article is examined in the inspecting position.

* * * * *